US005334906A

United States Patent [19]

Muzeroll

[11] Patent Number: 5,334,906

[45] Date of Patent: Aug. 2, 1994

[54] METAL HALIDE ARC DISCHARGE LAMP HAVING SHORT ARC LENGTH

[75] Inventor: Martin E. Muzeroll, Merrimack, N.H.

[73] Assignee: OSRAM Sylvania Inc., Danvers, Mass.

[21] Appl. No.: 965,490

[22] Filed: Oct. 23, 1992

[51] Int. Cl.[5] ..... H01J 61/34; H01J 17/16

[52] U.S. Cl. ..... 313/25; 313/620

[58] Field of Search ..... 313/25, 620, 634

[56] References Cited

U.S. PATENT DOCUMENTS

| | | | |
|---|---|---|---|
| 3,897,594 | 7/1975 | Popp et al. | 313/620 |
| 4,929,863 | 5/1990 | Verbeek et al. | 313/620 X |
| 5,144,201 | 9/1992 | Graham et al. | 313/620 X |

*Primary Examiner*—Sandra L. O'Shea

*Attorney, Agent, or Firm*—Joseph S. Romanow; William H. McNeill

[57] ABSTRACT

A metal halide arc discharge lamp includes a sealed light-transmissive outer jacket, a light-transmissive shroud located within the outer jacket and an arc tube assembly located within the shroud. The arc tube assembly includes an arc tube, electrodes mounted within the arc tube and a fill material for supporting an arc discharge. The electrodes have a spacing such that an electric field in a range of about 60 to 95 volts per centimeter is established between the electrodes. The diameter of the arc tube and the spacing of the electrodes are selected to provide an arc having an arc diameter to arc length ratio in a range of about 1.6 to 1.8. The fill material includes mercury, sodium iodide, scandium triiodide and a rare gas, and may include lithium iodide. The lamp exhibits a high color rendering index, high lumen output and high color temperature.

16 Claims, 3 Drawing Sheets

METAL HALIDE ARC DISCHARGE LAMP HAVING SHORT ARC LENGTH

GOVERNMENT RIGHTS

The Government may have rights in this invention pursuant to Contract No. NAS9-18200 awarded by NASA.

FIELD OF THE INVENTION

This invention relates to metal halide arc discharge lamps and, more particularly, to double-ended metal halide arc discharge lamps which have a relatively large arc diameter to arc length ratio and which have a high color rendering index and lumen output.

BACKGROUND OF THE INVENTION

Metal halide arc discharge lamps are frequently employed in commercial usage because of their luminous efficacy and long life. A typical metal halide arc discharge lamp includes a quartz or fused silica arc tube that is hermetically sealed within an outer jacket or envelope. The arc tube, itself hermetically sealed, has tungsten electrodes mounted therein and contains a fill material including mercury, metal halide additives and a rare gas to facilitate starting. In some cases, particularly in high wattage lamps, the outer envelope is filled with nitrogen or another inert gas at less than atmospheric pressure. In other cases, particularly in low wattage lamps, the outer envelope is evacuated.

Double-ended metal halide lamps have been developed for low wattage and other special applications. An arc tube is mounted within a light-transmissive outer jacket and the ends of the outer jacket are press sealed, with the arc tube electrical leads extending through the press seals. The lamp is mechanically supported at both ends, and electrical energy is applied to opposite ends of the lamp. It has been found desirable to provide metal halide lamps with a shroud which comprises a generally cylindrical, light-transmissive member, such as quartz. The arc tube and the shroud are coaxially mounted within the outer jacket, with the arc tube located within the shroud. A double-ended metal halide arc discharge lamp utilizing a light-transmissive shroud is disclosed in U.S. application Ser. No. 07/866,381, filed Apr. 10, 1992 now U.S. Pat. No. 5,296,779.

Double-ended metal halide lamps typically have a power rating of 150 watts or lower. Existing lamps typically have an arc diameter to arc length ratio of about 0.73:1 and produce a color rendering index of 60 to 65 when dosed with a fill material including sodium iodide and scandium tri-iodide. Color rendering index (CRI) is a well-known measure of the ability of a lamp to reproduce color, with a CRI of 100 indicating exact representation of colors. The electric field strength in these lamps is typically about 50 volts per centimeter.

In some applications of metal halide lamps, careful optical control is required. Optical control is difficult with lamps which have a long arc length. Optical control is enhanced for lamps with relatively large arc diameter to arc length ratios, which more nearly approximate a point source. In such lamps however, the color rendering index, the luminous efficacy and the color temperature must meet or exceed the parameters obtained in prior art metal halide lamps.

It is a general object of the present invention to provide improved metal halide arc discharge lamps.

It is another object of the present invention to provide arc discharge lamps having a relatively large arc diameter to arc length ratio.

It is a further object of the present invention to provide arc discharge lamps which have a high color rendering index, a high luminous efficacy and a high color temperature.

It is yet another object of the present invention to provide metal halide arc discharge lamps which are low in cost and which are easily manufactured.

SUMMARY OF THE INVENTION

According to the present invention, these and other objects and advantages are achieved in an arc discharge lamp comprising a sealed, light-transmissive outer jacket, a light-transmissive shroud disposed within the outer jacket and an arc tube assembly disposed within the shroud. The arc tube assembly comprises a light-transmissive arc tube, first and second electrodes mounted within the arc tube and a fill material within the arc tube for supporting an arc discharge. The double-ended arc discharge lamp further comprises means for coupling electrical energy through the outer jacket to the first and second electrodes in the arc tube. The first and second electrodes have a spacing such that an electric field in a range of about 60 to 95 volts per centimeter is established between the first and second electrodes.

The arc discharge lamp of the invention is preferably a double-ended metal halide lamp. Preferably, the diameter of the arc tube and the spacing of the first and second electrodes are dimensioned to provide an arc having an arc diameter to arc length ratio in a range of about 1.6 to 1.8. In a preferred embodiment, the arc diameter to arc length ratio is about 1.6. The fill material preferably comprises sodium iodide and scandium tri-iodide, and may also include lithium iodide. The sodium iodide to scandium tri-iodide ratio is preferably in a range of 11:1 to 24:1 to obtain a high color rendering index.

According to another aspect of the invention, an arc tube assembly comprises a light-transmissive arc tube, first and second electrodes mounted within the arc tube and a fill material within the arc tube for supporting an arc discharge when electrical energy is supplied to the first and second electrodes. The electrodes have a spacing and the arc tube has a diameter selected to produce an arc having an arc diameter to arc length ratio in a range of about 1.6 to 1.8.

For a better understanding of the present invention, together with other and further objects, advantages and capabilities thereof, reference is made to the accompanying drawings, which are incorporated herein by reference and in which.

DETAILED DESCRIPTION OF THE INVENTION

Figure 1:
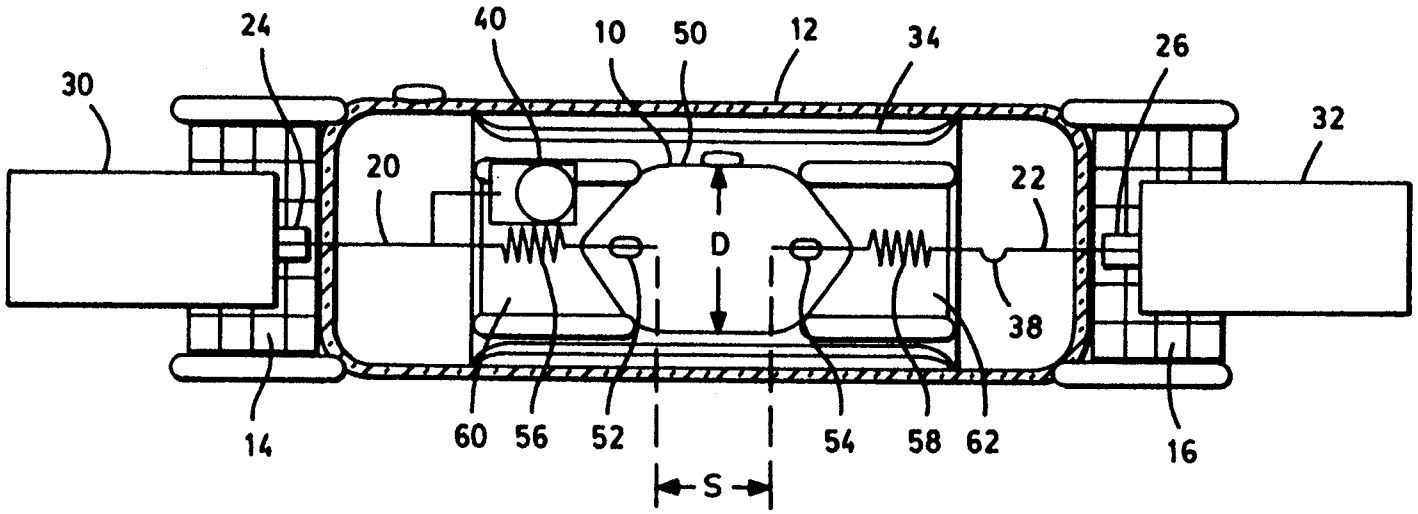
FIG. 1 is a cross-sectional view of a double-ended metal halide arc discharge lamp in accordance with the present invention.

A double-ended metal halide arc discharge lamp in accordance with the present invention is shown in FIG. 1. An arc tube assembly 10 is sealed within an outer jacket 12. The outer jacket 12 is hermetically sealed at opposite ends by press seals 14 and 16. Press sealing techniques are well known in the art. Electrical leads 20 and 22 extend from opposite ends of arc tube assembly 10 to molybdenum foil conductors 24 and 26, respectively, in the press seals. External electrical contacts 30 and 32 are connected to foil conductors 24 and 26, respectively. A light-transmissive shroud 34 is located between the arc tube assembly 10 and the outer jacket 12. The arc tube assembly 10 is supported within outer jacket 12 by electrical leads 20 and 22. The shroud 34 preferably includes flared ends which contact the inner surface of outer jacket 12. Shroud 34 is supported by outer jacket 12, as described in more detail in the aforementioned application Ser. No. 07/866,381, which is hereby incorporated by reference. The electrical leads 20 and 22 preferably include an expansion section 38. A getter assembly 40 is mounted to electrical lead 20.

The arc tube assembly 10 includes a quartz or fused silica arc tube 50 having electrodes 52 and 54 sealed therein. The electrodes 52 and 54, which preferably comprise thoriated tungsten, are electrically connected to molybdenum foil conductors 56 and 58 in press seals 60 and 62, respectively. Electrical leads 20 and 22 are connected to foil conductors 56 and 58, respectively. The arc tube 50 encloses a fill material for supporting an arc discharge. The fill material typically includes mercury, one or more metal halide additives and a rare gas such as argon.

The outer jacket 12 is preferably light-transmissive quartz and has a tubular shape, except in the regions of press seals 14 and 16. The shroud 34 is typically a cylindrical quartz tube and is supported at its flared ends by the outer jacket 12. Preferably, the shroud 34 has a wall thickness in a range of about 0.75 mm to 1.5 mm.

In accordance with the present invention, the fill material, the spacing S between electrodes 52 and 54, and the inside diameter D of arc tube 50 are selected to provide improved performance. In particular, the spacing S between electrodes 52 and 54 is selected such that an electric field strength in a range of about 60 to 95 volts per centimeter is established within arc tube 50 during operation. Preferably, the electric field strength is equal to or greater than about 65 volts per centimeter. For a given lamp voltage, the electric field strength is determined by the spacing between electrodes. The lamp voltage is a function of the fill material, particularly mercury. By contrast, the electric field strength in prior art metal halide lamps is typically about 50 volts per centimeter. Furthermore, the spacing S and the diameter D are selected to provide a relatively large ratio of arc diameter to arc length. The arc length is established by the spacing S, and the arc diameter is established by the inside diameter D of arc tube 50. Preferably, the arc diameter to arc length ratio is in a range of about 1.6 to 1.8. The fill material comprises mercury, sodium iodide, scandium tri-iodide and argon, and may include lithium iodide in some cases. The ratio of sodium iodide to scandium tri-iodide is preferably in a range from about 11:1 to 24:1 to obtain a high color rendering index and high lumen output. The mercury dose is selected to provide a desired operating voltage, typically about 90 volts.

In a preferred embodiment, the arc diameter to arc length ratio is approximately 1.6, with a spacing S of 9.5 mm and an inside diameter D of 15 mm. The operating voltage is about 90 volts. The fill material comprises 31 mg of mercury, 3.5 mg of sodium iodide, 6.5 mg of scandium tri-iodide and argon at a pressure of 150 torr. In the preferred embodiment, the shroud 34 had an inside diameter of 20 mm and an outside diameter of 22 mm. The ratio of the inside diameter of the outer jacket 12 to the outside diameter of the shroud 34 was 1.14 to 1. The ratio of the inside diameter of shroud 34 to the outside diameter of arc tube 50 was 1.18:1.

For a lamp constructed in accordance with the invention, the color rendering index was found to be in the range of 70–85 with luminous efficacies of about 75 lumens per watt. For some fill materials, typically those including lithium iodide in addition to sodium iodide and scandium tri-iodide, the CRI was in the range of 80–85, but the lumen output was relatively low. For other fill materials, typically those including sodium iodide and scandium tri-iodide in a ratio of 11:1 to 24:1 but no lithium iodide, the CRI was in the range of 70–80 and the lumen output was relatively high. By contrast, prior art double-ended metal halide lamps in the 150 watt range and having a smaller arc diameter to arc length ratio typically produce a color rendering index of 60 to 65. Furthermore, lamps in accordance with the invention have a color temperature in the range from 3500° K. to 4500° K.

Figure 2:
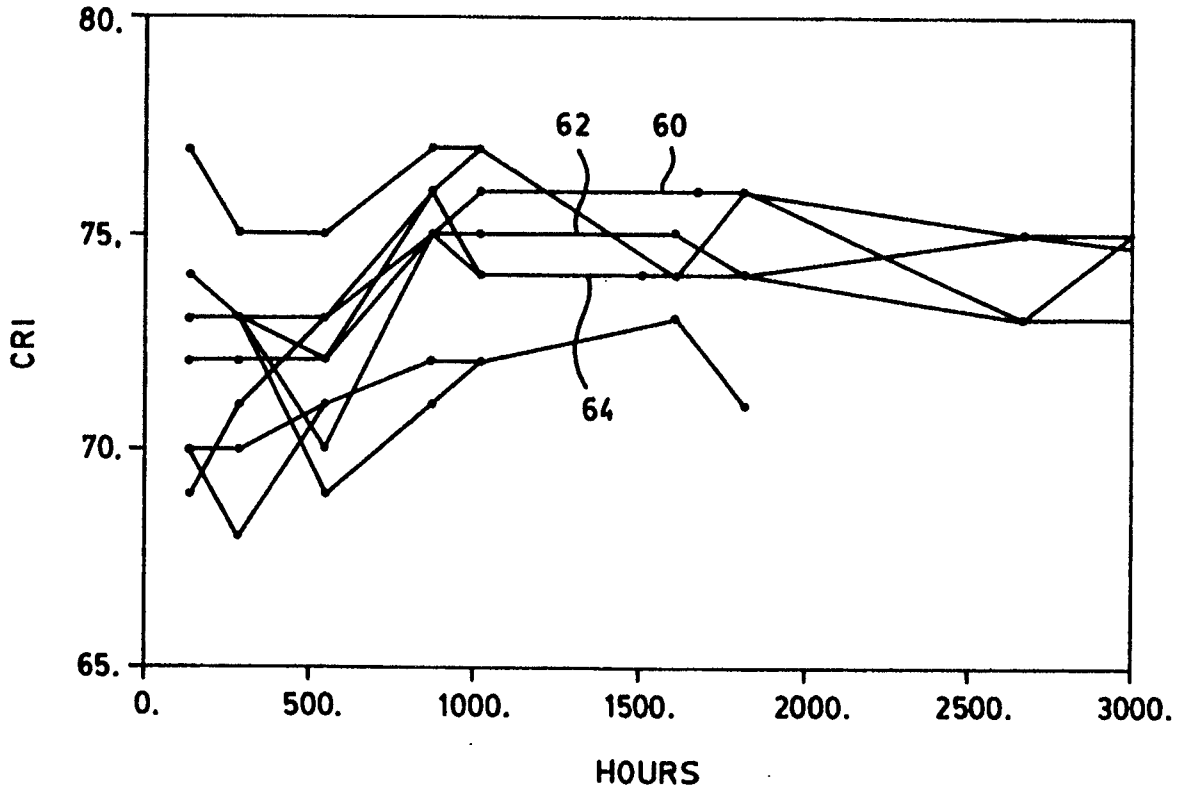
FIG. 2 is a graph of color rendering index as a function of time for several lamps constructed in accordance with the present invention.
Figure 3:
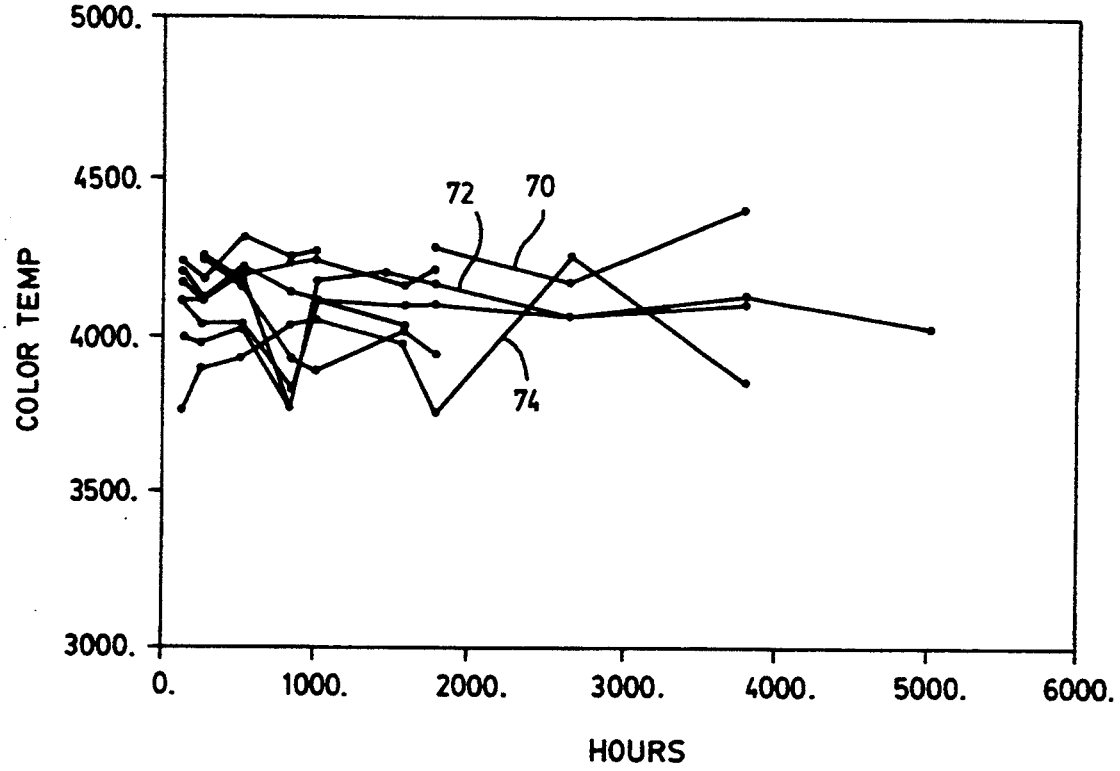
FIG. 3 is a graph of color temperature as a function of time for several lamps constructed in accordance with the present invention.
Figure 4:
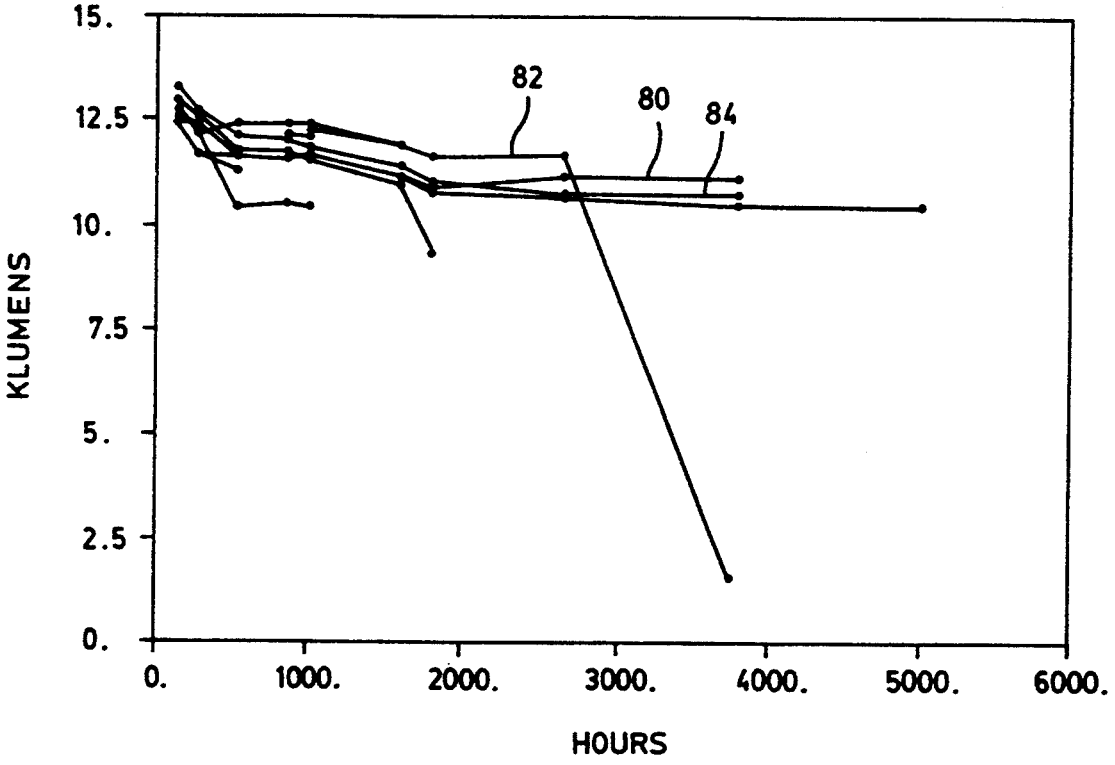
FIG. 4 is a graph of light output in thousands of lumens as a function of time for several lamps constructed in accordance with the present invention.

Test results for double-ended metal halide lamps constructed in accordance with the present invention are shown in FIGS. 2–4. Nine test lamps had a spacing between electrodes 52 and 54 of 9.5 mm. The inside diameter D of arc tube 50 was 15 mm. The arc tube voltage was nominally 90 volts. The fill material for each arc tube included sodium/scandium iodides. The color rendering index is plotted as a function of time in FIG. 2. Curves 60, 62, 64, etc. represent the results for different test lamps. The color temperature is plotted as a function of time in FIG. 3. Curves 70, 72, 74, etc. represent the results for different test lamps. The light output in thousands of lumens is plotted as a function of time in FIG. 4. Curves 80, 82, 84, etc. represent the results for different test lamps. In general, the test lamps produced a color rendering index in the range of about 70 to 80, a color temperature typically above 4000° K. and a light output in the range of 11,500 to 13,000 lumens.

The arc tube assembly of the present invention has been shown and described above in the context of a double-ended lamp. However, the arc tube assembly of the invention is not limited to use in double-ended lamps and can be used in any other suitable lamp, such as for example a single-ended lamp.

In summary, the metal halide lamp of the present invention provides a relatively short arc, an unexpectedly high color rendering index, high color temperature and high lumen output over a long operating life. The lamp is useful for applications which require a small physical size, high intensity and a high color rendering index.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An arc discharge lamp comprising:

a sealed, light-transmissive outer jacket;

a light-transmissive shroud disposed within said outer jacket:

an arc tube assembly disposed within said shroud, said arc tube assembly comprising a light-transmissive arc tube, first and second electrodes mounted within said arc tube and a fill material within said arc tube for supporting an arc discharge; and means for coupling electrical energy through said outer jacket to the first and second electrodes in said arc tube, said first and second electrodes having a spacing such that an electric field in a range of about 60 to 95 volts per centimeter is established between said first and second electrodes during operation.

2. An arc discharge lamp as defined in claim 1 wherein the spacing of said first and second electrodes is such that an electric field equal to or greater than about 65 volts per centimeter is established between said first and second electrodes during operation.

3. An arc discharge lamp as defined in claim 1 wherein said fill material comprises sodium iodide and scandium tri-iodide, a ratio of sodium iodide to scandium tri-iodide being in a range of 11:1 to 24:1.

4. An arc discharge lamp as defined in claim 1 wherein said outer jacket is double-ended and the diameter of said arc tube and the spacing of said first and second electrodes are dimensioned to provide an arc having an arc diameter to arc length ratio in a range of 1.6 to 1.8.

5. An arc discharge lamp as defined in claim 4 wherein the diameter of said arc tube and the spacing of said first and second electrodes are dimensioned to provide an arc having an arc diameter to arc length ratio of about 1.6.

6. An arc discharge lamp as defined in claim 5 wherein the spacing of said first and second electrodes is about 9.5 millimeters.

7. An arc discharge lamp as defined in claim 6 wherein the ratio of the inside diameter of said outer jacket to the outside diameter of said shroud is about 1.14:1.

8. An arc discharge lamp as defined in claim 7 wherein the ratio of the inside diameter of said shroud to the outside diameter of said arc tube is about 1.18:1.

9. An arc tube assembly comprising:

a light-transmissive arc tube;

first and second electrodes mounted within said arc tube; and a fill material within said arc tube for supporting an arc discharge when electrical energy is supplied to said first and second electrodes, said electrodes having a spacing and said arc tube having a diameter to produce an arc having an arc diameter to arc length ratio in a range of 1.6 to 1.8.

10. An arc tube assembly as defined in claim 9 wherein the spacing of said first and second electrodes is such that an electric field in a range of about 60 to 95 volts per centimeter is established between said first and second electrodes during operation.

11. An arc tube assembly as defined in claim 9 wherein said fill material comprises sodium iodide and scandium tri-iodide, a ratio of sodium iodide to scandium tri-iodide being in a range of 11:1 to 24:1.

12. An arc tube assembly as defined in claim 9 wherein said fill material comprises sodium iodide, scandium tri-iodide and lithium iodide.

13. An arc tube assembly as defined in claim 9 wherein the diameter of said arc tube and the spacing of said first and second electrodes are dimensioned to provide an arc having an arc diameter to arc length ratio of about 1.6.

14. An arc tube assembly as defined in claim 10 wherein said first and second electrodes are mounted at opposite ends of said arc tube and have a spacing of about 9.5 millimeters.

15. An arc tube assembly as defined in claim 14 wherein said fill material includes sufficient mercury to establish an operating voltage of about 90 volts.

16. A double-ended arc discharge lamp comprising:

a sealed, light-transmissive outer jacket;

a light-transmissive shroud disposed within said outer jacket:

an arc tube assembly disposed within said shroud, said arc tube assembly comprising a light-transmissive arc tube, first and second electrodes mounted within said arc tube and a fill material within said arc tube for supporting an arc discharge; and means for coupling electrical energy through opposite ends of said outer jacket to the first and second electrodes in said arc tube, said electrodes having a spacing and said arc tube having a diameter to produce an arc having an arc diameter to arc length ratio in a range of 1.6 to 1.8.

* * * * *